US006302283B1

(12) United States Patent
Yeh

(10) Patent No.: US 6,302,283 B1
(45) Date of Patent: Oct. 16, 2001

(54) DISPLAY RACK

(76) Inventor: Wen-Chun Yeh, No. 45, Chung Shan Rd., Peitou, Taipei (TW)

( * ) Notice: Subject to any disclaimer, the term of this patent is extended or adjusted under 35 U.S.C. 154(b) by 0 days.

(21) Appl. No.: 09/621,539

(22) Filed: Jul. 21, 2000

(51) Int. Cl.[7] ..... A47F 5/00

(52) U.S. Cl. ..... 211/186; 211/135; 211/149; 211/187; 108/109; 248/174; 248/243

(58) Field of Search ..... 211/186, 187, 211/149, 59.1, 57.1, 135, 90.02; 108/107, 109; 248/174, 220.31, 220.41, 220.42, 220.43, 243

(56) References Cited

U.S. PATENT DOCUMENTS 3,844,231 * 10/1974 Peacock ..... 108/107
4,064,996 * 12/1977 Shillum ..... 248/243 X
4,422,608 * 12/1983 Hogg .
4,575,164 * 3/1986 Pinnow et al. ..... 108/109 X
4,860,905 * 8/1989 Schott et al. ..... 211/59.1
5,273,169 * 12/1993 Maglione ..... 211/149
5,379,976 * 1/1995 DeGirolamo .
5,415,302 * 5/1995 Carlson et al. ..... 211/187
5,503,277 * 4/1996 O'Brien ..... 211/59.1 X
6,068,140 * 5/2000 Mangrum et al. ..... 108/107 X
6,135,033 * 10/2000 Defarrari ..... 211/135 X

* cited by examiner

*Primary Examiner*—Robert W. Gibson, Jr.
(74) *Attorney, Agent, or Firm*—Rabin & Berdo, P.C.

(57) ABSTRACT

The present invention relates to a display rack primarily including a main frame made of light-weight plastic corrugated board and a number of movable partitions supported by a number of supporting pieces fixed on the main frame so that the main frame is divided by the partitions into a number of holding rooms. The present invention is characterized in that the corrugated board of the main frame has a plurality of grooved rails longitudinally disposed in parallel. The supporting pieces are made of hard material and include at least one blocking extension strip at one side thereof which is vertical to the surface of the supporting pieces. The surface of the supporting piece is fitted with a locking groove near the bottom end of the blocking extension strip in order that the protruding blocking extension strip of the supporting piece is able to be inserted into the grooved rails while the locking groove near the bottom end of the blocking extension strip is fixed on the surface of the main frame. Accordingly, stable supporting elements on which the partitions are placed are created.

4 Claims, 4 Drawing Sheets

DISPLAY RACK

BACKGROUND OF THE INVENTION

1. Field of the Invention

The present invention relates to a display rack, and more particularly, to a display rack which is light, strong and stable in construction, convenient to fold, easy to assemble and is protected from being moistened and softened. The display rack is suitable for placing at a supermarket or also at a shop in order for the salesmen or the clerk to introduce the commodities.

2. Description of the Prior Art

A common display rack is made of three-ply wood, metal, acrylic material or even corrugated cardboard. Most racks made of acrylic board include projecting pins and receiving grooves which are attached to one another by glue. Besides, the cut pieces are connected to one another by means of a strong bonding agent to form a rack. However, it's heavy in weight and not easy to be disassembled after assembly. Therefore, it's not easy to carry. Moreover, its assembly is complicated and its mobility is worse so that it's not a practical display rack. The display rack made of wood is a so-called "DIY"-product in which many wood plates are screwed together to form a frame of the rack. Thereafter, a number of prepared partitions are fixed at proper positions by means of screws or nails. Another kind of screw can also be used, one end of which is driven into the wood while the other end thereof is projecting for supporting the partitions. However, the wood of this kind of structure is heavy and not easy to carry. Moreover, the high price is also the main disadvantage. Additionally, the thread of the screws will be destroyed if the screws are loosened and turned into again after being forced into the wood. Even if it is used again, the whole structure is easily unstable. Furthermore, it is time-wasting to nail at a certain position of the wood. Accordingly, it's not an excellent display rack.

Also, another display rack of corrugated cardboard at supermarkets is not stable enough, and it can only hold goods of ligh weight. In addition, the paper is easily softened due to being moistened. A three-dimensional display rack has to be constituted by a folding frame of an extremely complicated structure. It's not easy to be disassembled after assembly. If it is forced for disassembling, the whole structure is destroyed and can't be used any more. Consequently, it is not a good display rack, too

SUMMARY OF THE INVENTION

In order to remove the above-mentioned disadvantages of the conventional display rack, it is therefore a primary object of the present invention to provide a display rack which includes a frame and a plurality of movable partitions. The frame is constituted by corrugated boards which have a great number of grooved rails in parallel. Moreover, a plurality of supporting pieces made of hard material includes blocking extension strips at one side thereof which are vertical to the surface of the supporting pieces. The surface of the supporting piece is fitted with a locking groove near the bottom end of the blocking extension strip in order that the protruding blocking extension strips of the supporting piece are able to be inserted into the grooved rails while the locking groove near the bottom end of the blocking extension strip is fixed on the surface of the frame. Accordingly, stable supporting elements on which the partitions are placed are created.

It is a further object of the present invention to provide a display rack in which the partition includes side flaps disposed above the supporting pieces and fitted with locking holes. Each of T-shaped locking pieces of hard material has a longitudinal projection serving as insertion strip which is inserted into the grooved rail while the laterally projecting spigot at the other end of thereof is vertically protruding to the surface of the main frame, serving for the locking hole of two side flaps of the partition to be engaged into.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
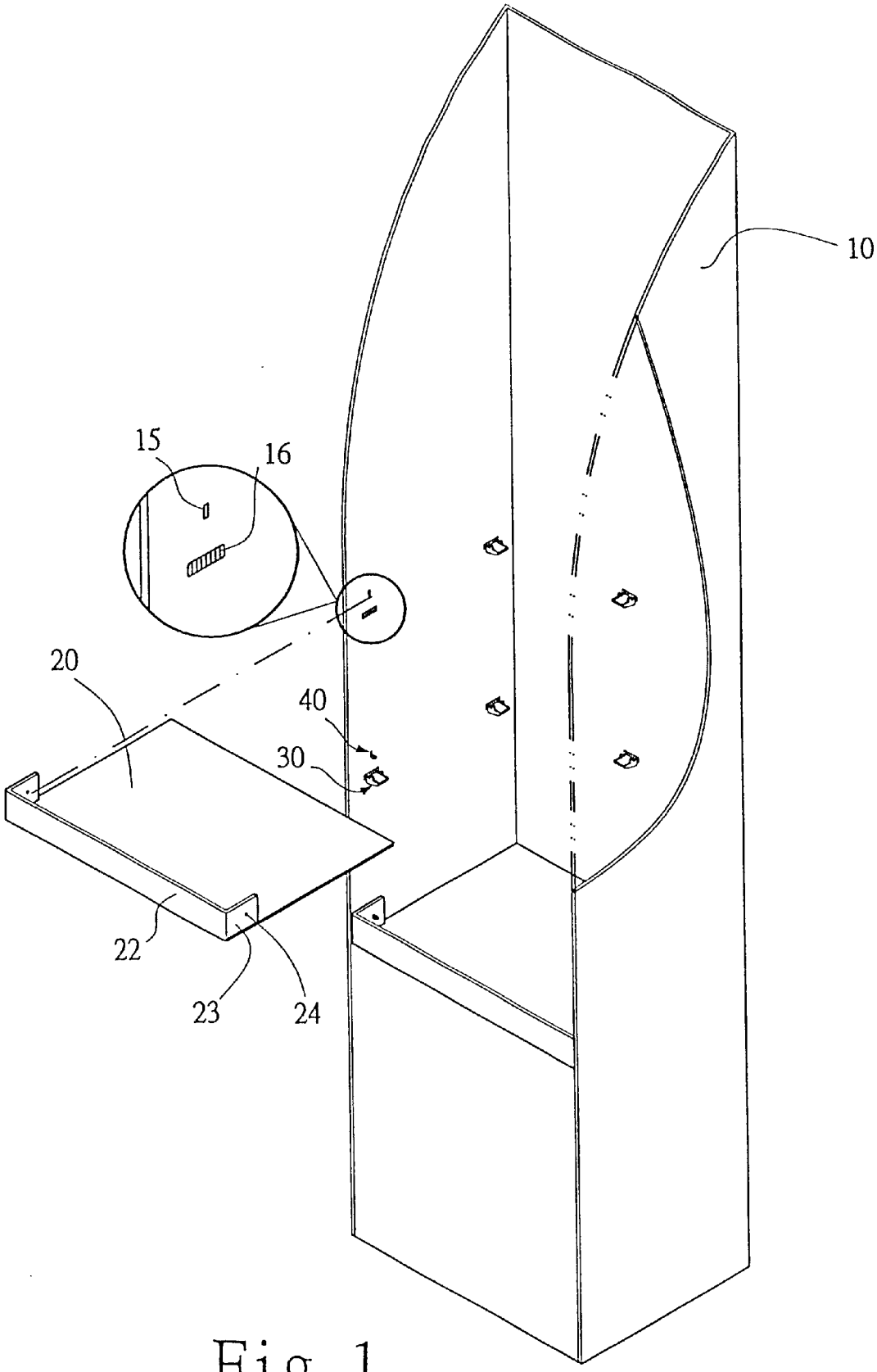
FIG. 1 is a partially exploded and sectional view of the present invention.
Figure 2:
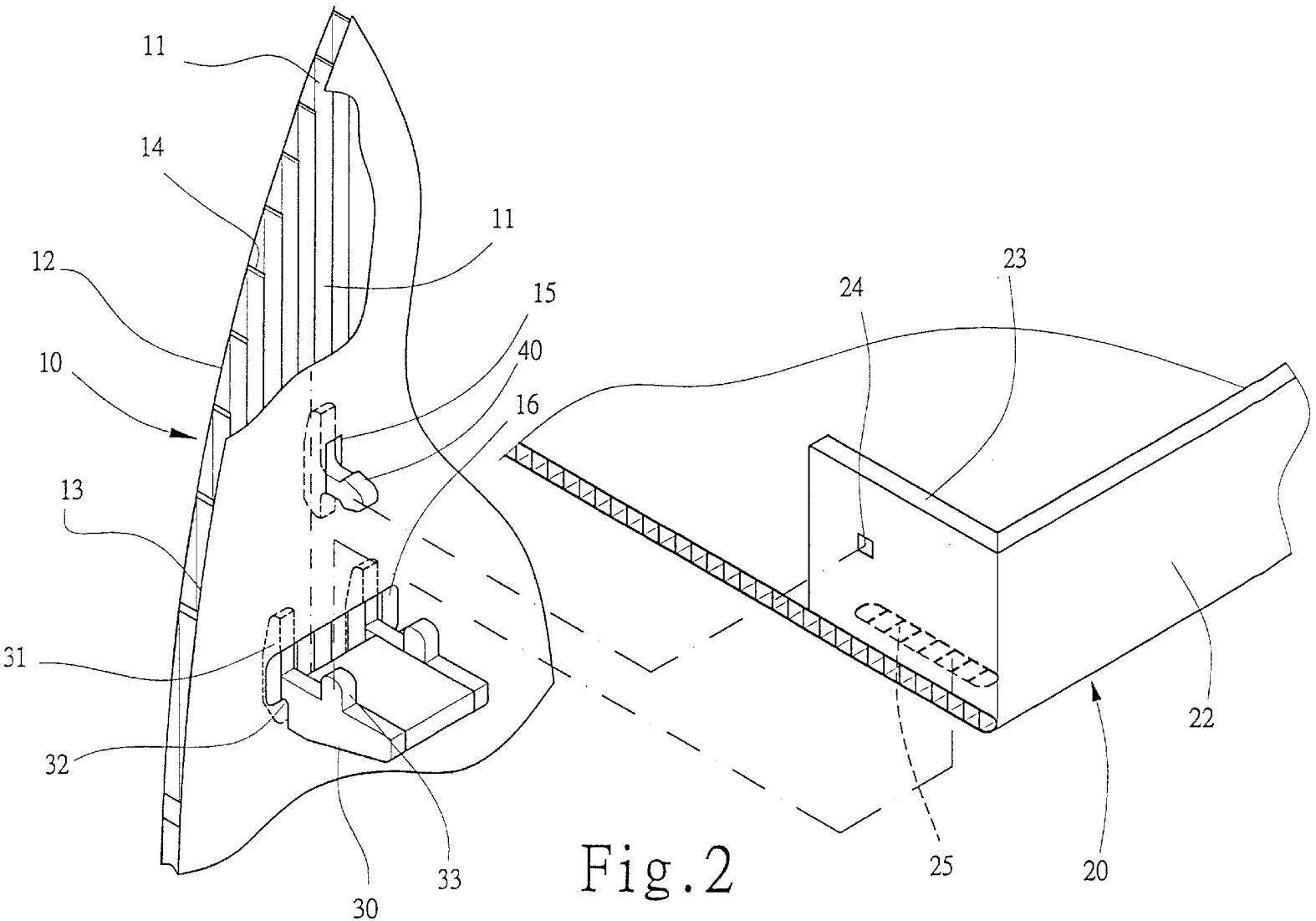
FIG. 2 is an enlarged view of the present invention in partial section.

First of all, referring to FIG. 1, a display rack in accordance with the present invention primarily includes a main frame 10 of light and strong material (e.g. corrugated plastic board), a plurality of movable partitions 20, a plurality of supporting pieces 30 and locking pieces 40 of hard material (e.g. plastic or acrylic material) which altogether compose a display rack. The main frame 10 includes triple-sided folded body which is laterally divided by the partitions 20 into many layers for holding objects. As shown in FIG. 1 and 2, a plurality of longitudinal raised pieces 14 parallel arranged in an isodistant manner are disposed between two surfaces 12, 13 of the main frame 10 so that a grooved rail 11 between every two raised pieces 14 is formed on an inner surface of the main frame. In addition, a plurality of upper slots 15 and lower slots 16 of proper size are disposed on a surface 13 at the inner side of the main frame 10.

Figure 3:
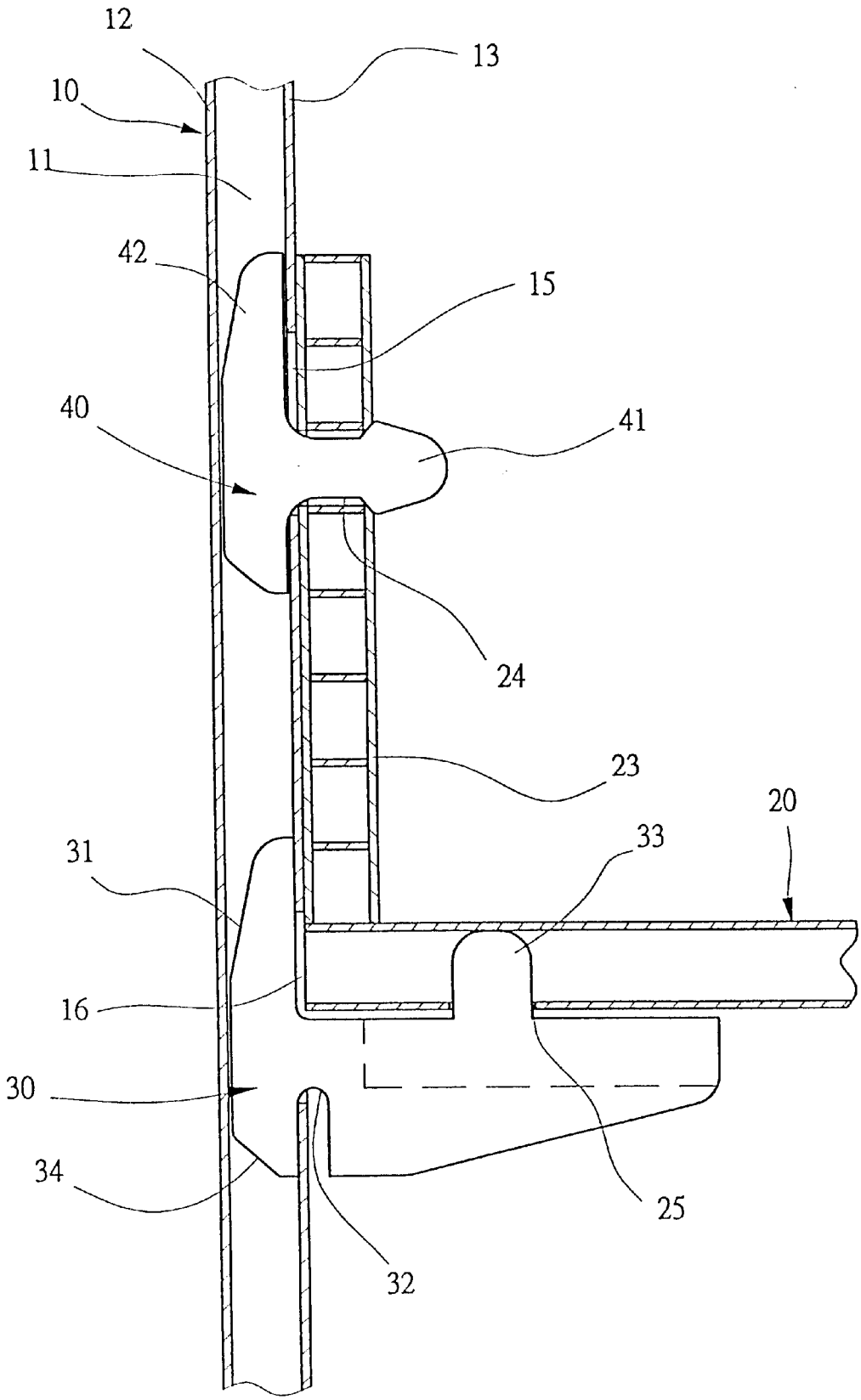
FIG. 3 is an partially enlarged view of the present invention in longitudinal section when assembled.

Referring to FIG. 1 again, the partitions 20 includes a front end stop 22 having side flaps 23 extending and protruding at two sides of the front end stop 22. Each side flap 23 is provided with a locking hole 24. As shown in FIGS. 2 and 3, the partition 20 is fitted with a plurality of propping holes 25 at the side of the bottom end thereof.

Referring to FIG. 1, 2 and 3, a plurality of supporting pieces 30 and locking pieces 40 of the main frame 10 are used to support the partitions 20. The supporting piece 30 includes a vertical blocking extension strip 31 at the end of two sides of a supporting surface thereof respectively. The blocking extension strip 31 extends upwards with a certain height and downwards to the position of the lower end of the surface of the supporting pieces 30. Moreover, the lower end of the blocking extension strip 31 is made in a manner of sloping comer 34, and the supporting pieces 30 include a narrow locking groove 32 at the lower end thereof near the blocking extension strip 31. Furthermore, a plurality of locking posts 33 projects upwards from the surface of the supporting pieces 30.

Figure 4:
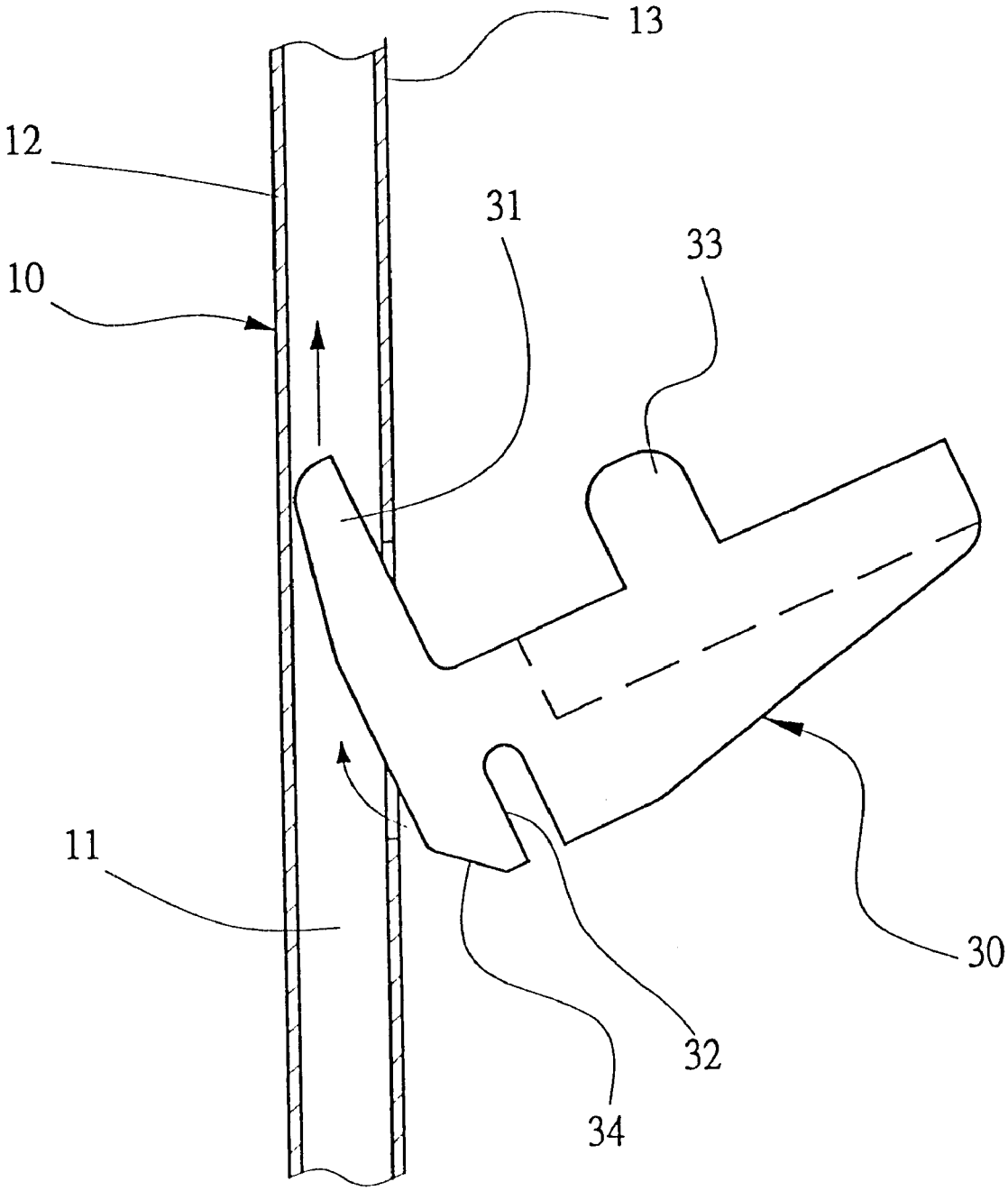
FIG. 4 is a schematic drawing of the present invention, illustrating the attachment of a lower supporting piece to a grooved rail.

Referring to FIG. 2, 3 and 4, the supporting pieces 30 are inserted from the lower slots 16 at the inner side of the main frame 10 into the longitudinal grooved rail 11 by means of the upper end of the blocking extension strips 31. As shown in FIG. 4, the sloping corner 34 at the lower end thereof facilitates its insertion into the grooved rail 11. As shown in FIG. 3, the locking groove 32 at the lower end of the supporting pieces 30 is engaged into the surface 13 of the inner side of the main frame 10 in order that the supporting pieces 30 is fixed on the main frame 10. Thereafter, the partition 20 is placed on the top of the supporting piece 30, and the locking post 33 is locked into the propping hole 25 so that the partitions 20 and the supporting pieces 30 are in a stable connection.

Again, referring to FIGS. 2 and 3, the locking pieces 40 are created in a flat manner and are approximately inverted-T-shaped, and include an insertion strip 42 vertically extending at the side end thereof. The outer side of the bottom end thereof is made in a sloping corner. Each of the locking pieces 40 has a laterally projecting spigot 41. The locking piece 40 is inserted by means of the insertion strip 42 into the upper slot 15 and fixed in the grooved rail 11. The spigot 41 is horizontally projecting to the surface of the main frame 10. Referring to FIGS. 2 and 3, the partitions 20 are placed on the top of the supporting pieces 30 while the spigot 41 is locked into the locking hole 24 of the side flap 23 of the partition 20. Accordingly, the partitions 20 can be fixed more stably.

The advantages of the present invention can be concluded as follows: 1. The display rack and the partitions 20 are made of light and strong plastic corrugated board. The supporting pieces 30 and the locking pieces 40 are all small plastic parts. Therefore, being light-weight and easy to carry are the main advantages of the present invention. 2. The supporting pieces 30 and the locking pieces 40 serving as supporting elements can be rapidly inserted into the main frame 10. In cooperation with the partitions 20, a wonderful display rack is created. In addition, it's also practical in folding. This is a further advantage of the present invention. 3. The main frame 10 is folded by the corrugated board so that it's practical in folding and developing. It's not required to use nails or strong bonding agent for fixing. Also, it's not required to make holes so that the processing time can be saved and the production cost is therefore reduced. This is a further advantage of the present invention.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A display rack, comprising:

a main frame made of light-weight plastic corrugated board and having a plurality of grooved rails longitudinally disposed in parallel on a surface of said main frame;

a plurality of movable partitions; and a plurality of supporting pieces fixable on said main frame for supporting respective ones of said partitions so that said main frame is divided by said partitions into a number of holding rooms, said supporting pieces being made of a hard material, and each including at least one blocking extension strip at one side thereof which is vertical to a supporting surface of the supporting pieces, each said supporting piece having a locking groove near a bottom end of the blocking extension strip to allow said blocking extension strip to be inserted into said grooved rails, said locking groove being fixable on the surface of said main frame to provide a stable supporting element on which the partitions are placed.

2. The display rack as claimed in claim 1, wherein said blocking extension strip includes a sloping corner at an outer side of the bottom end thereof in order to facilitate the insertion thereof into said grooved rail.

3. The display rack as claimed in claim 1, wherein each said partition includes side flaps disposable above said supporting pieces and fitted with locking holes, further comprising a plurality of T-shaped locking pieces formed of hard material, each locking piece having a longitudinal projection at one end thereof and serving as an insertion strip which is inserted into the grooved rail of said main frame, and each having a laterally projecting spigot at another end thereof that protrudes horizontally relative to the surface of said main frame, each said locking piece engaging with a respective locking hole.

4. The display rack as claimed in claim 1, wherein each said supporting piece includes a plurality of locking posts extending upwards and being insertable into a bottom of said partition for being fixed thereto.

* * * * *